US009835358B2

(12) United States Patent
Jin et al.

(10) Patent No.: US 9,835,358 B2
(45) Date of Patent: Dec. 5, 2017

(54) BALANCED HIGH EFFICIENCY OUTDOOR HEATER

(71) Applicants: Weiqun Jin, Shenzhen (CN); Weidong Jin, Shenzhen (CN)

(72) Inventors: Weiqun Jin, Shenzhen (CN); Weidong Jin, Shenzhen (CN)

( * ) Notice: Subject to any disclaimer, the term of this patent is extended or adjusted under 35 U.S.C. 154(b) by 583 days.

(21) Appl. No.: 14/472,318

(22) Filed: Aug. 28, 2014

(65) Prior Publication Data

US 2015/0300685 A1 Oct. 22, 2015

(30) Foreign Application Priority Data

Apr. 22, 2014 (CN) ..... 2014 2 0198567

(51) Int. Cl.

| | |
|---|---|
| ***F24H 3/00*** | (2006.01) |
| ***F24H 9/02*** | (2006.01) |
| ***F23D 14/12*** | (2006.01) |
| ***F24H 9/20*** | (2006.01) |
| ***F24C 3/04*** | (2006.01) |

(52) U.S. Cl.

CPC ..... *F24H 3/006* (2013.01); *F23D 14/12* (2013.01); *F24C 3/042* (2013.01); *F24H 9/02* (2013.01); *F24H 9/2085* (2013.01)

(58) Field of Classification Search

CPC .... F24C 1/10; F24C 1/12; F24C 3/042; F23D 14/12; F23D 14/10; F24H 3/006; F24H 9/02; F24H 9/2085; F26B 3/30

USPC ..... 126/91 R

See application file for complete search history.

(56) References Cited

U.S. PATENT DOCUMENTS

| | | | | |
|---|---|---|---|---|
| 6,023,033 A * | 2/2000 | Yagi | ..... | H01H 13/705 200/341 |
| 7,886,734 B2 * | 2/2011 | Jin | ..... | F24C 3/122 126/92 AC |
| 8,993,938 B2 * | 3/2015 | Hall, Jr. | ..... | F24D 19/1096 219/536 |

FOREIGN PATENT DOCUMENTS

| | | | | |
|---|---|---|---|---|
| CN | 202328491 U * | 7/2012 | | |
| EP | 0514930 A2 * | 11/1992 | ..... | F23D 14/12 |
| FR | WO 2014029846 A1 * | 2/2014 | ..... | F23D 14/16 |

* cited by examiner

*Primary Examiner* — Kenneth Rinehart
*Assistant Examiner* — Alex Girard
(74) *Attorney, Agent, or Firm* — Raymond Y. Chan; David and Raymond Patent Firm

(57) ABSTRACT

A balanced high efficiency outdoor heater is provided to increase the heat radiation area, and to improve the stability of the structure. The heater includes a burner provided at an upper end of a standing column, a bottom base provided at a lower end of the standing column, and a beam is set between the burner and the standing column. The beam and the standing column are connected by pipe fittings. An ignition control device is equipped inside the base and is connected to the burner. An electrode rod and a thermocoupler are connected to the ignition control device under the burner. A first reflector is fixedly connected to the lower end of the burner and a gas valve is equipped in the bottom base. Compared with the prior art, the burner uses sintered felt and a heating surface of the burner faces upside down to improve thermal efficiency.

10 Claims, 7 Drawing Sheets

BALANCED HIGH EFFICIENCY OUTDOOR HEATER

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a heater.

Description of Related Arts

Currently, most outdoor heaters use standing columns to prop up burners, for example, patent CN 20052000535 U discloses an infrared remote control heating stove, which uses a standing column to prop up its burner; by arranging a reflecting cover above the burner to reflect the heat; that infrared remote control heating stove has some drawbacks such as low thermal efficiency and small heating space; the heat is circumferentially radiated, resulting in most of the heating area not being utilized; and using a standing column for connecting parts can easily cause the head part of the heater to become askew.

SUMMARY OF THE PRESENT INVENTION

The main object of the present invention is to provide a balanced high efficiency outdoor heater. The technical problem of the conventional heater to be solved is to increase the heating radiation area and improve the structural stability.

To solve the above mentioned problem, the present invention utilizes the following technical improvement: a balanced high efficiency outdoor heater includes a burner, and the burner is set at the upper end of a standing column, and the lower end of the standing column is provided with a bottom base, and the burner is an infrared burner, and a beam is set between the burner and the standing column, wherein the beam and the to standing column are connected by pipe fittings, and the rear end of the beam is provided with a base, and an ignition control device is equipped inside the base, and the burner is mounted on the front end of the beam, and the heating surface of the burner is facing downwards, and an electrode rod and a thermocoupler are connected to the ignition control device under the burner; a first reflector is fixedly connected to the lower end of the burner, and a gas valve is equipped in the bottom base, wherein an inlet and an outlet of the ignition control unit are connected to the burner by a gas pipe in the beam and a gas valve in the bottom base separately.

The present invention comprises a burner which further comprises a furnace cover with an opening facing downwards and a combustion chamber, and a furnace cover bracket is set on the upper end of the furnace cover being fixedly connected to the beam; an ejector pipe is transversely arranged inside the combustion chamber, and the ejector pipe is connected to the outlet of the ignition control device by gas pipes; a spoiler is upwardly bent arranged at the front end of the ejector pipe; the first reflector is arranged at the lower end of the furnace cover, and a sintered mat is fixedly set between the furnace cover and the first reflector which can cover the opening of the furnace cover.

The ignition control device of the present invention is a gas stove ignition switch, and the ignition switch shaft of the gas stove ignition switch extends from the rear end of the base, and a rotary knob is set on the ignition switch shaft.

The ignition control device of the present invention comprises an automatic gas control, a solenoid valve, a battery box, a valve dead plate, and an anti-dumping switch, and the automatic gas control, the solenoid valve, the battery box, and the anti-dumping switch are mounted on the valve dead plate by screws respectively, and the automatic gas control is connected to the battery box, the solenoid valve and the thermocouple respectively, and a first ejector pipe is connected to an outlet of the solenoid valve by gas pipes, and an inlet of the solenoid valve is connected to the gas valve; a key-press pad is fixedly connected to the rear end of the base, and the key-press pad is connected to a control wire end of the automatic gas control, and the key-press pad is provided a faceplate which is bonded to the key-press pad.

A second reflector is arranged between the sintered mat and the first reflector, and the reflector surface of the second reflector is smaller than the reflector surface of the first reflector; the second reflector, the first reflector and the sintered mat are fixedly connected to the furnace cover by screws successively.

The second reflector further comprises a gas-collecting hood which has a cavity inside; the upper end of the gas-collecting hood extends from the upper end of the second reflector, and the electrode and the thermocouple are arranged inside the cavity of the gas-collecting hood, and louvers are arranged on the lower end surface of the gas-collecting hood for wind shutter purposes.

The lower end of the second reflector is connected to a meshed shield cover.

Each of the pipe fittings are Tee pipe fittings.

The upper end of the burner is provided with a rain cover.

The present invention, compared with prior art, utilizes an infrared burner with a sintered mat, and the heating surface of the infrared burner faces downwards, in that case, the thermal efficiency is increased without an open flame; by utilizing the beam to increase the heating area, the whole heating area can be utilized; and the standing column is connected to the beam by pipe fittings, using such a balanced arrangement which can improve the structural stability.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
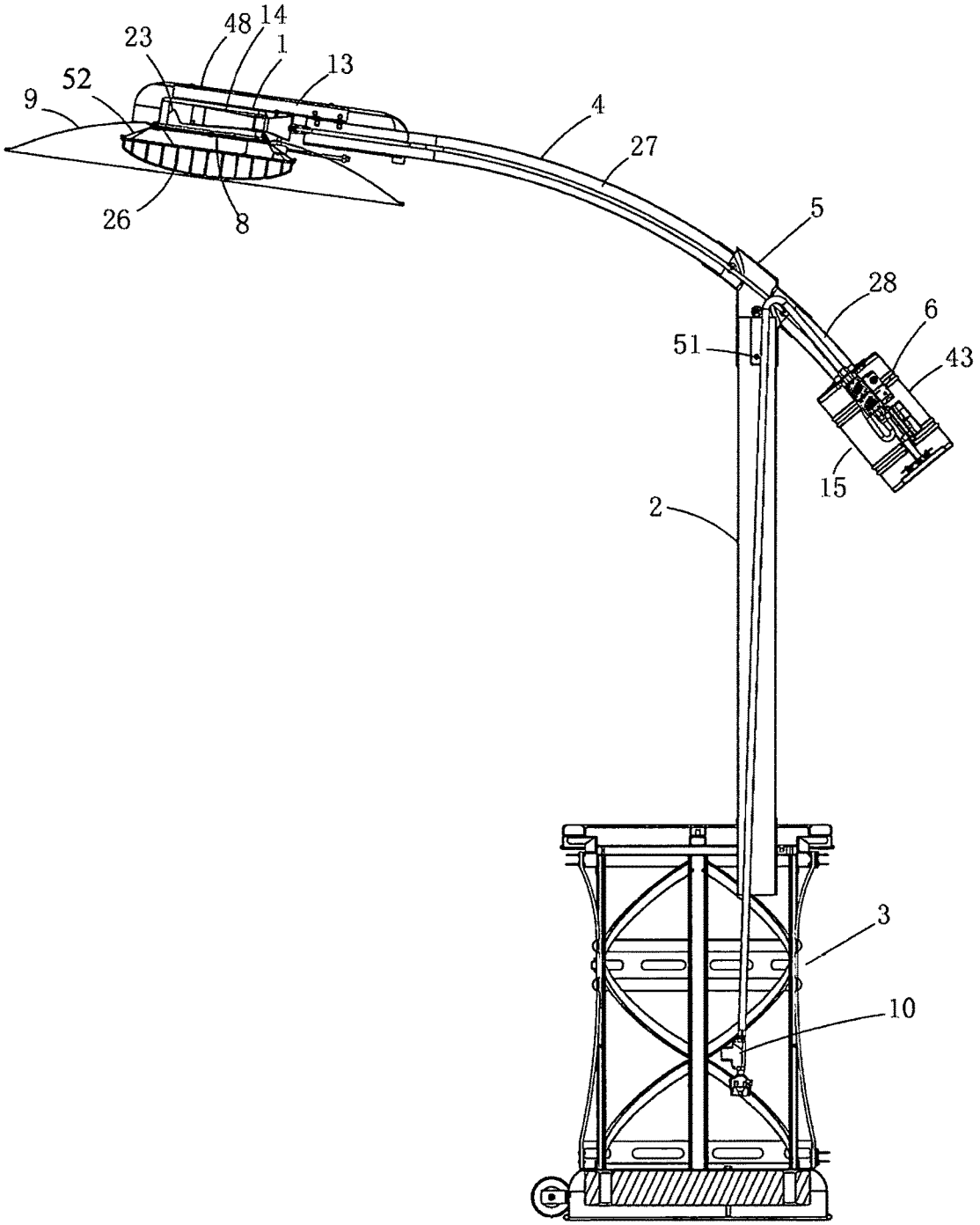
FIG. 1 is a structure schematic view of the present invention.

Referring to FIG. 1 of the drawings, a balanced high efficiency outdoor heater comprises a bottom base 3, and a standing column 2 is connected to the bottom base 3, and a curved beam 4 is connected to the upper end of the standing column 2 by pipe fittings, and a furnace cover bracket 13 is arranged at the front end of the beam 4 connecting by screws, and an ignition control device 6 is connected to the rear end of the beam 4; a burner 1 is mounted at the lower end of the furnace bracket 13 with the heating surface facing downwards, and the burner 1 is an infrared burner; the standing column 2 and the beam 4 both have a hollow tube structure, and two gas pipes are arranged inside the standing column 2 and the beam 4, wherein one gas pipe is connecting the burner 1 and an outlet of the ignition control device 6, and the another gas pipe is connected to a gas valve 10 and an inlet of the ignition control device 6, and on the upper end of the burner 1 is provided a rain cover 48.

The beam 4 has a two-section structure, which is a first beam 27 and a second beam 28 with the same outer diameters, and the length of the second beam 28 is less than the length of the first beam 27. The pipe fitting 5 is a tee pipe fitting. By connecting the pipe fitting 5 with the first beam 27, the second beam 28 and the standing column 2 by bolts, the interior of the first beam 27, the second beam 28 and the standing column 2 can communicate with each other, so that the gas pipes can be arranged therein.

A base 15 is set at the rear end of the second beam 28, and the base 15 is provided with a base cover 43 which can be opened, and the gas ignition device 6 is fixed in the base 15, and the burner 1 is connected to the front end of the first beam 27.

Figure 2:
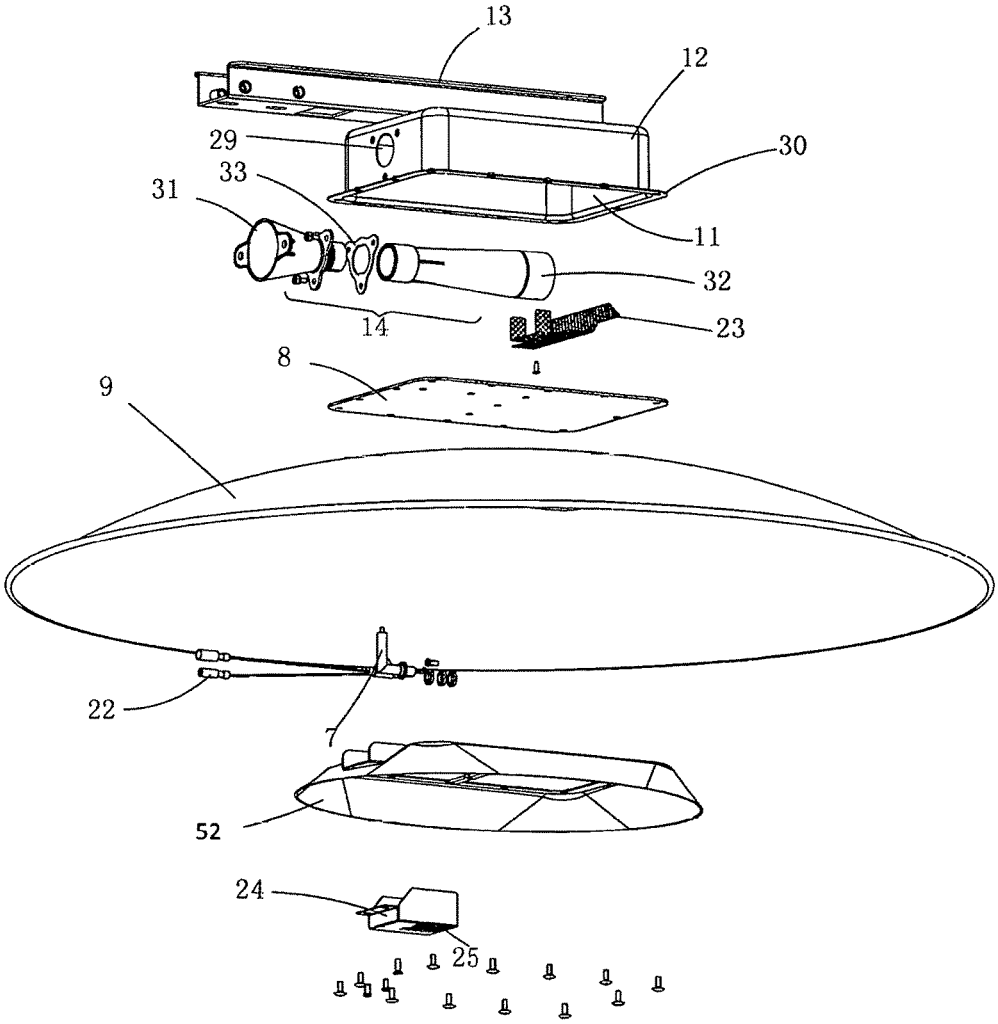
FIG. 2 is a perspective view illustrating the structure of a burner of the present invention.

Referring to FIG. 2, the burner 1 comprises a furnace cover 12 which is a cuboid, wherein the furnace cover 12 has an opening at the lower end, and the furnace cover 12 comprises a combustion chamber 11, and the upper end of the furnace cover 12 is connected to a furnace cover bracket 13 by screws; a furnace cover hole 29 is set on the rear end of the furnace cover 12, and an outer edge 30 is set on the opening of the furnace 12 for connecting other parts like a sintered mat which is extended outwardly, and an ejector pipe 14 is transversely mounted inside of the combustion chamber 11, and the rear end of the ejector pipe 14 is extended through the furnace cover hole 29 to the outside of the furnace cover 12, and the rear end of the ejector pipe 14 is hermetically connected to an outlet of the ignition control device 6 by gas pipes; a spoiler 23 being bent upwardly is fixedly connected to the lower end of the pipe orifice at the front end of the ejector pipe 14, and some small holes are evenly distributed on the spoiler 23; the upwardly bent part of the spoiler 23 blocks the front pipe orifice of the ejector pipe 14, so that exhaust gas from the ejector pipe 14 is guided to the upper end of the inner wall of the furnace cover 12 and be reflected to the front inner wall of the furnace cover 12, and the gas is exhausted downward; beneath the combustion chamber 11 is provided with an electrode 7 and a thermocouple 22, and at the lower end opening of the furnace cover 12 is provided with a sintered mat 8 which can completely cover the opening, and the gas is finally discharged to the upper end surface of the sintered mat 8 and burned there, and at the lower end of the sintered mat 8 is successively equipped a first reflector 9 and a second reflector 52 by screws, and the first reflector 9 is in a flared shape, and the shape and the size of the upper end opening of the first reflector 9 is adapted with that of the sintered mat 8, and the opening diameter of the upper end opening of the first reflector 9 is smaller than the opening diameter of the lower end opening; and the reflect surface of the second reflector 52 is smaller than that of the first reflector 9, and the second reflector 52 is also in a flared shape, and the shape and the size of the upper end opening of the second reflector 52 is adapted with that of the sintered mat 8, and the lower end opening diameter is larger than that of the upper end opening; at the rear side of the upper opening of the second reflector 52 is equipped with a gas-collecting hood 24, and a cavity is set inside the gas-collecting hood 24, and after the gas-collecting hood being mounted in the second reflector 52, the upper end of the gas-collecting hood 24 is extended through the upper end opening of the second reflector 52, and on the lower end surface of the gas-collecting hood 24 is provided with some gas-collecting hood holes 25.

A shield cover 26 is mounted at the lower end of the second reflector 52, wherein the shield cover 26 is a strip meshed cover, and the shield cover can be connected to the second reflector 52 by screws, and can also be connected to the second reflector 52 by providing some holes on the second reflector 52, and by using some column which can fit with the holes to fix the shield cover 26.

Furthermore, the thermocouple 22 and the electrode 7 are arranged inside the cavity of the gas-collecting hood 24. The electrode 7 and the thermocouple 22 are connected by screws on the dead plate of the second reflector 52.

Furthermore, the ejector pipe 14 can be set into two sections, which is a first ejector pipe 31 and a second ejector pipe 32, and the first ejector pipe 31 is connected by screws to the rear end of the furnace cover hole 29 and outside of the furnace cover 12, and the front end of the first ejector pipe 31 is plugged into the furnace cover hole 29, and the second ejector pipe 32 is muff-coupled to the front end of the first ejector pipe 31, and the second ejector pipe 32 is thread connected to the first ejector pipe 31; the second ejector pipe is set inside the combustion chamber 11, and the spoiler 23 is mounted at the front end orifice of the second ejector pipe 32; at the connection part of the first ejector pipe 31 and the second ejector pipe 32 is provided with a gasket 33, when the ejector pipe is set into two sections, the outlet of the ignition control device 6 is connected to the first ejector pipe 31 by gas pipes, and the first ejector pipe 31 is connected to the gas pipes by thread connection.

Figure 3:
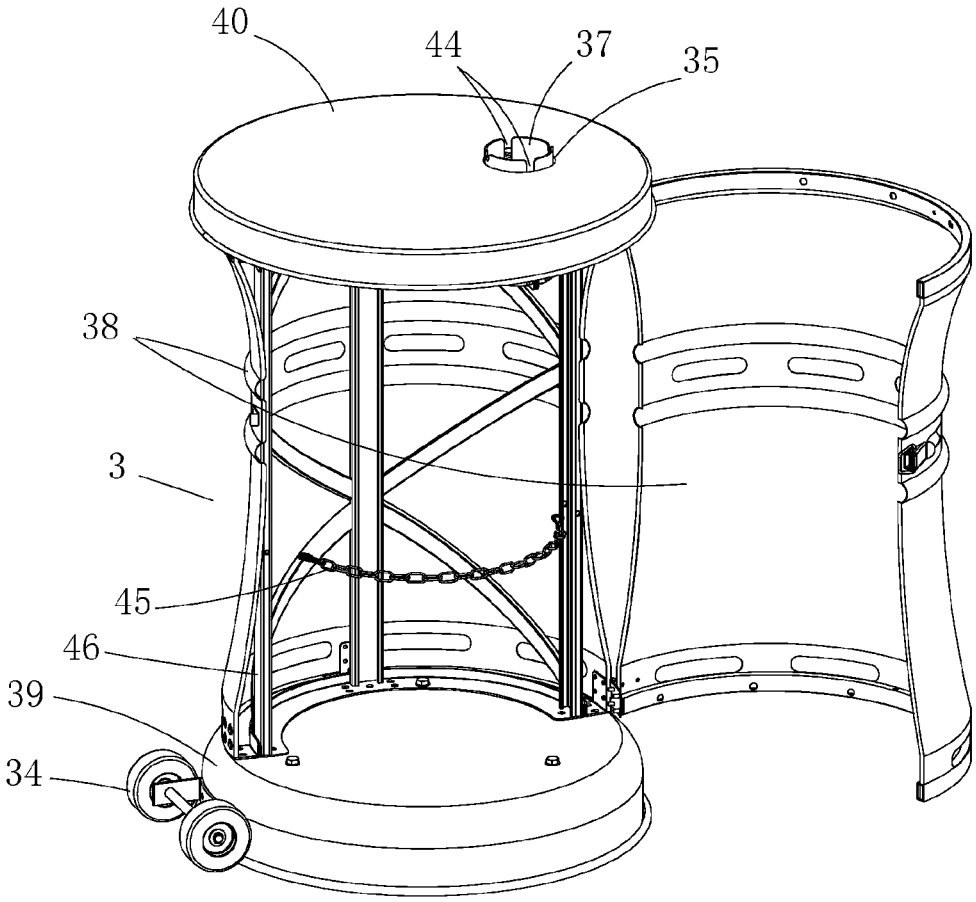
FIG. 3 is a first structure schematic view of a base of the present invention.
Figure 4:
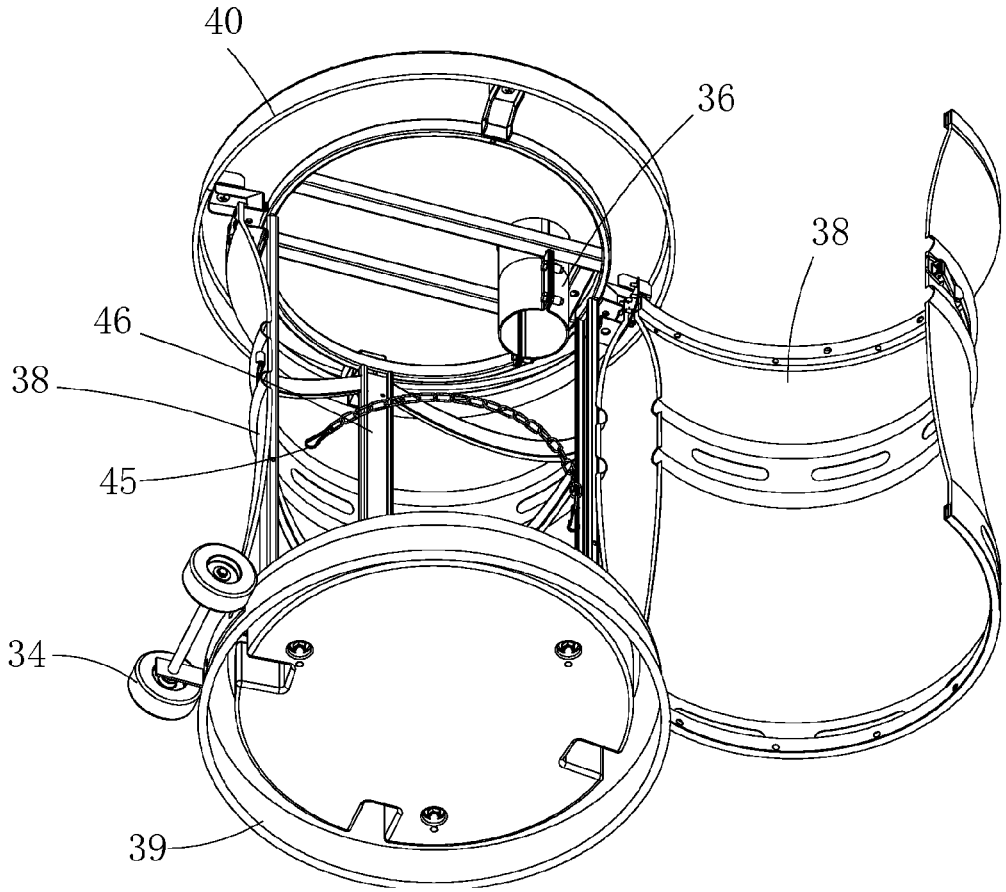
FIG. 4 is a second structure schematic view of a base of the present invention.

Referring to FIG. 3 and FIG. 4, the bottom base 3 has an internal hollow barrel structure, which comprises an upper and a lower circular surface referred to as a bottom surface 39 and a top surface 40 respectively, two pieces of semi-circular cross-sectional shaped shells 38 and a framework 46, and the two shells 38 are hinged on one side, and the other side of the two shells 38 are connected by a snap joint, after the two shells 38 are combined together, they form a cylindrical barrel body, and a gas cylinder can be placed inside the bottom base 3; after the gas cylinder is connected to the gas valve 10, the gas cylinder can supply air for the burner 1; wheels 34 are provided on the rear side peripheral wall of the bottom surface 39, and a column hole 35 is provided on the top surface 40 for column inserting purpose, and the column hole 35 is set at the front side of the top surface 40; a hollow column holder 37 is arranged in the column hole 35, and the column holder 37 is fixed within the column hole 35; the peripheral wall of the column holder 37 is provided with grooves 44 along the axial direction, and an adjustable pipe clamp 36 is set at the lower end of the column holder 37 and inside the bottom base 3 which is extended to the lower end of the bottom base 3, and after the standing column 2 is plugged into the column hole 35, screws can be locked into the standing column 2 from the grooves 44, and by tightening nuts on the pipe clamp 36, the standing column 2 is fixed within the column holder 37.

Furthermore, a chain 45 is set in the bottom base 3 for fixing the gas cylinder, and two ends of the chain 45 are connected to the framework 46 by buckles which are detachable.

Figure 5:
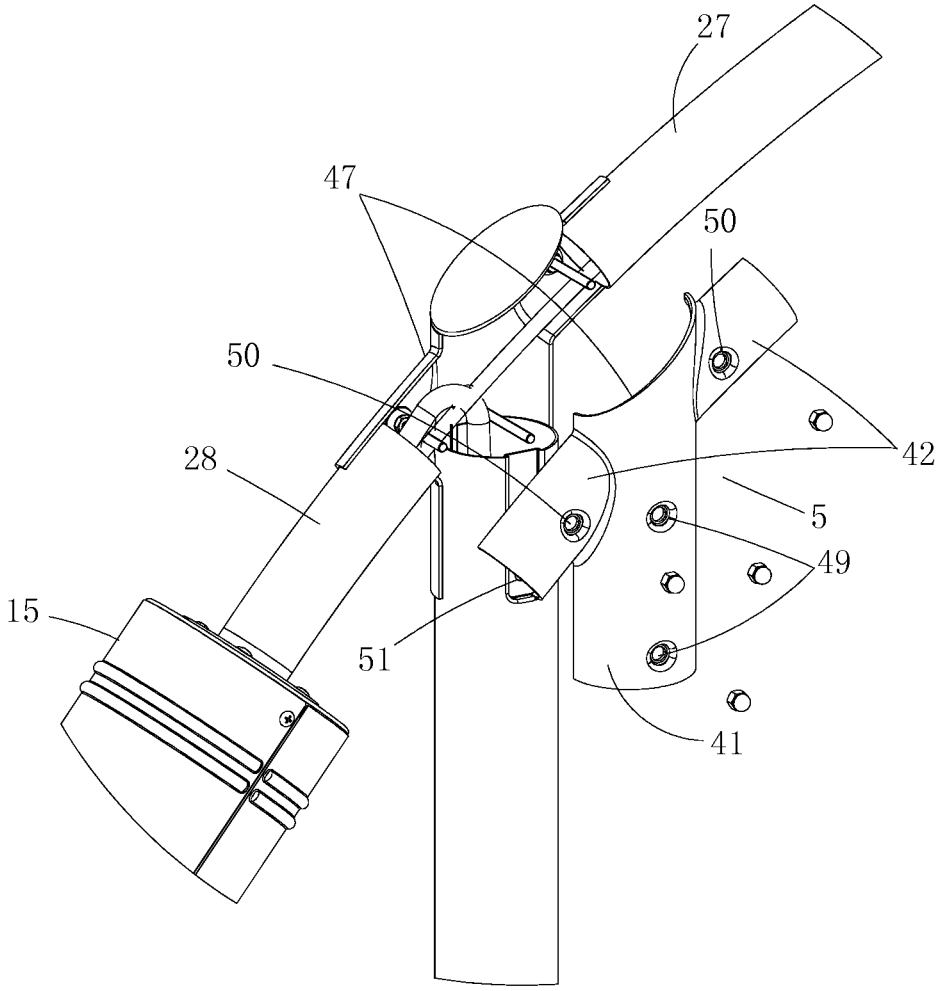
FIG. 5 is a schematic view illustrating the connecting part between the beam and the standing column.

Referring to FIG. 5, the pipe fittings 5 are tee pipe fittings, and the pipe fittings 5 comprise a left and a right pipe pieces 47 which are symmetrical to each other, and the pipe pieces 47 further comprise a column fixing part 41 for connecting with the standing column 2 and a beam fixing part 42 for connecting with the two beams, and the beam fixing part 42 is arranged on the front and rear sides of the column fixing part 41, and cross-sectional shape of the column fixing part 41 and the beam fixing part 41 are both semi-circle; and the inner diameter of the column fixing part 41 is equal to the outer diameter of the standing column 2; and the inner diameter of the beam fixing part 42 is equal to the outer diameter of the beam, and after combing the two pipe pieces 47 together, the cross-section of the column fixing part 41 forms a circle, and the cross-section of the beam fixing part 42 forms a circle. Two first screw holes 49 are provided on the column fixing part 41 along the axial direction, and two second screw holes 50 are provided on the two beam fixing parts 42 with one on each side respectively, and a third screw hole 51 is provided on the standing column 2 at the corresponding position to that of the first screw hold 49 on the lower end of the column fixing part 41, and the two pipe pieces 47 can hold the column and the beam by inserting bolts into the first screw hole 49, the second screw hole 50 and the third screw hole 51 and using nuts to tighten the bolts, so that the column, the beam and the pipe pieces are fixedly connected.

Figure 6:
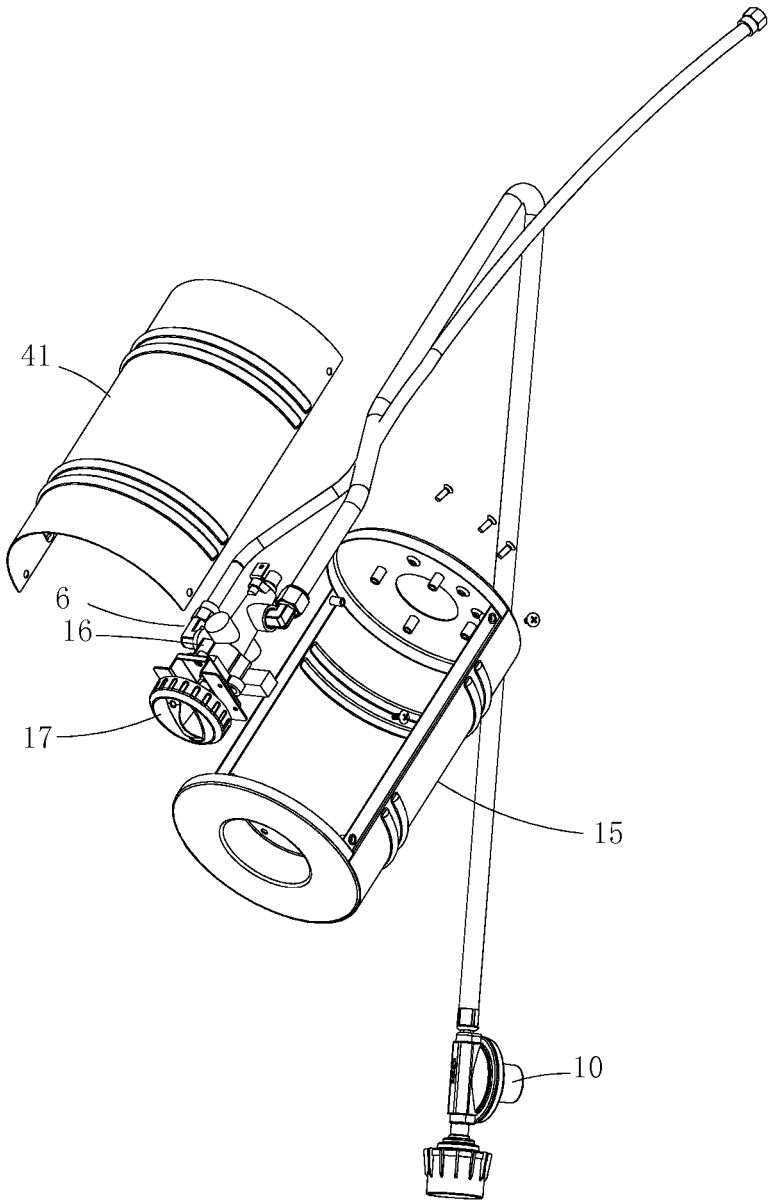
FIG. 6 is a structure schematic view illustrating a first preferred embodiment of the ignition control device of the present invention.

Referring to FIG. 6, the first embodiment of the ignition control device 6 can utilizes a manual type gas stove ignition switch 16 of the prior art, and an ignition switch shaft of the gas stove ignition switch 16 extends to the rear end of the base 15, and a rotary nob 17 is provided on the ignition switch shaft of the gas stove ignition switch 16, and the rotary nob 17 is set at outside of the rear end of the base 15, and the electrode 7 is connected to the ignition wire of the gas stove ignition switch 16, and the thermocoupler 22 is connected to a signal wire of the gas stove ignition switch 16, and an outlet of the gas stove ignition switch 16 is connected to the first ejector pipe 31 by pipes, and an inlet of the gas stove ignition switch 16 is connected to the gas valve 10 by pipes.

The manual type gas stove ignition switch 16 can also utilize the SRSV03 gas ignition device which is produced by SHINERICH INDUSTRIAL Co., Ltd. (the burner in China Patent No. CN 20052000535 U).

Figure 7:
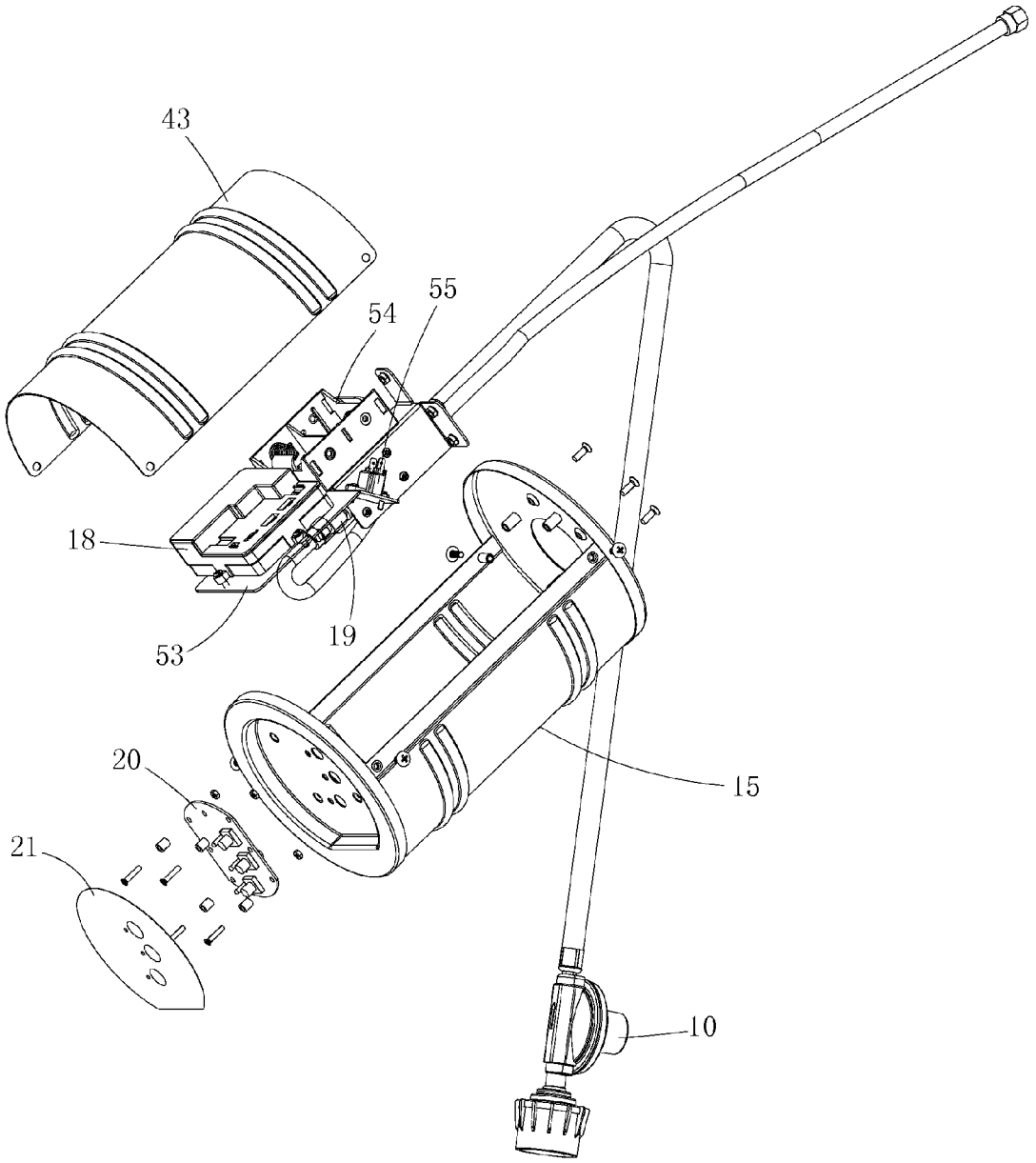
FIG. 7 is a structure schematic view illustrating a second preferred embodiment of the ignition control device of the present invention.

Referring to FIG. 7, the ignition control device 6 comprises an automatic gas control 18, a solenoid valve 19, a battery box 54, a valve dead plate 53 and an anti-dumping switch 55, and the power line of the automatic gas control 18 is connected to the battery box 44 which provides power for the ignition control device 6. The solenoid valve wire end of the automatic gas control 18 is connected to the solenoid valve 19. The anti-dumping switch 55 and the thermocouple 22 are connected to a signal sensing wire end of the automatic gas control 18 respectively. The first ejector pipe 31 is connected to an outlet of the solenoid valve 19 by gas pipes, and an inlet of the solenoid valve 19 is connected to the gas valve 10 by gas pipes, and an ignition wire of the automatic gas control 18 is connected to the electrode 7; a key-press pad 20 is fixedly connected to the rear end of the base 15, and the key-press pad 20 is connected to a control wire end of the automatic gas control 18, and a faceplate 21 is provided on the key-press pad 20, and the faceplate is bolted on the key-press pad 20. The ignition control device 6 can also be connected following the wire connecting arrangement of the ignition control device in China Patent No. CN 20052000535 U.

When in use, by rotating the rotary nob 17 or pressing the ignition key on the key-press pad 20, gas goes into the combustion chamber 11 via gas pipes and the ejector pipe 14, which the electrode 7 discharges to ignite, so that the gas is burned on the upper end surface of the sintered mat 8. Because the gas is burned on the sintered mat 8, an infrared effect can be achieved. When heat is reflected downward by the second reflector 52 and the first reflector 9, an effect of efficiently radiated heat can be achieved.

As a result of no open flame being used in the present invention, the thermal efficiency is increased over 30%, and even in a windy environment, the function of the burner is not effected, and the ignition control device uses a module design, which makes the maintenance more convenient.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A balanced high efficiency outdoor heater, comprising:

a burner arranged on an upper end of a standing column, wherein said burner comprises an infrared burner and a furnace cover, wherein said furnace cover comprises:

a combustion chamber with an opening facing downwards;

a furnace cover bracket arranged on an upper end of said furnace cover;

an ejector pipe being transversely arranged inside said combustion chamber;

a spoiler being upwardly bent arranged at a front end of said ejector pipe; and a sintered mat covering an opening of said furnace cover;

a bottom base arranged on a lower end of said standing column;

a beam being equipped between said burner and said standing column, wherein said beam is fixedly connected to said standing column using pipe fittings, wherein said furnace cover bracket arranged on said upper end of said furnace cover is connected with said beam;

a base arranged at a rear end of said beam, wherein an ignition control device is equipped inside said base, wherein said burner is mounted at a front end of said beam, wherein a heating surface of said burner is facing upside down, wherein said ejector pipe connects to said ignition control device by one or more gas pipes, wherein said ignition control device is a gas stove ignition switch, wherein an ignition switch shaft of said gas stove ignition switch extends to a rear end of said base, wherein a rotary knob is arranged on the ignition switch shaft of said gas stove ignition switch;

an electrode and a thermocouple connected to said ignition control device being arranged under said burner;

a first reflector fixedly connected to a lower end of said burner, wherein said sintered mat is fixedly connected between said furnace cover and said first reflector, wherein said first reflector is arranged at a lower end of said furnace cover;

a gas valve arranged in said bottom base, wherein an inlet and an outlet of said ignition control device connect to said burner by one of said gas pipes; and a second reflector being arranged between said sintered mat and said first reflector, wherein a reflector surface of said second reflector is smaller than a reflector surface of said first reflector, wherein said second reflector, said first reflector and said sintered mat are fixedly connected to said furnace cover by screws successively.

2. A balanced high efficiency outdoor heater, as recited in claim 1, wherein said second reflector further comprises a gas-collecting hood with a cavity inside; wherein an upper end of said gas-collecting hood extends from an upper end of said second reflector, and said electrode and said thermocouple are arranged inside said cavity of said gas-collecting hood, wherein louvers are arranged on a lower end surface of said gas-collecting hood for wind shutter.

3. A balanced high efficiency outdoor heater, as recited in claim 2, wherein a lower end of said second reflector connects to a meshed shield cover.

4. A balanced high efficiency outdoor heater, as recited in claim 3, wherein said pipe fittings are Tee pipe fittings.

5. A balanced high efficiency outdoor heater, as recited in claim 4, wherein an upper end of said burner is provided with a rain cover.

6. A balanced high efficiency outdoor heater, comprising:

a burner arranged on an upper end of a standing column, wherein said burner comprises an infrared burner and a furnace cover, wherein said furnace cover comprises:

a combustion chamber with an opening facing downwards;

a furnace cover bracket arranged on an upper end of said furnace cover;

an ejector pipe being transversely arranged inside said combustion chamber;

a spoiler being upwardly bent arranged at a front end of said ejector pipe; and a sintered mat covering an opening of said furnace cover;

a bottom base arranged on a lower end of said standing column;

a beam being equipped between said burner and said standing column, wherein said beam is fixedly connected to said standing column using pipe fittings, wherein said furnace cover bracket arranged on said upper end of said furnace cover is connected with said beam;

a base arranged at a rear end of said beam, wherein an ignition control device is equipped inside said base, wherein said burner is mounted at a front end of said beam, wherein a heating surface of said burner is facing upside down, wherein said ejector pipe connects to said ignition control device by one or more gas pipes, wherein said ignition control device comprises an automatic gas control, a solenoid valve, a battery box, a valve dead plate and an anti-dumping switch, wherein said automatic gas control, said solenoid and said battery box and said anti-dumping switch are installed by screw on said valve dead plate respectively, wherein a first ejector pipe is connected to a gas outlet of said solenoid valve through said gas pipes and a gas inlet of said solenoid valve is connected to a gas pressure regulator through said gas pipes; and wherein a key-press pad fixedly connects to the rear end of said base, wherein said key-press pad is connected to a control wiring end of said automatic gas control, wherein a faceplate is arranged to be bonded with said key-press pad;

an electrode and a thermocouple connected to said ignition control device being arranged under said burner, wherein said automatic gas control is connected to said battery box and said solenoid valve and said thermocouple, respectively;

a first reflector fixedly connected to a lower end of said burner, wherein said sintered mat is fixedly connected between said furnace cover and said first reflector, wherein said first reflector is arranged at a lower end of said furnace cover;

a gas valve arranged in said bottom base, wherein an inlet and an outlet of said ignition control device connect to said burner by one of said gas pipes; and a second reflector being arranged between said sintered mat and said first reflector, wherein a reflector surface of said second reflector is smaller than a reflector surface of said first reflector, wherein said second reflector, said first reflector and said sintered mat are fixedly connected to said furnace cover by screws successively.

7. A balanced high efficiency outdoor heater, as recited in claim 6, wherein said second reflector further comprises a gas-collecting hood with a cavity inside; wherein an upper end of said gas-collecting hood extends from an upper end of said second reflector, and said electrode and said thermocouple are arranged inside said cavity of said gas-collecting hood, wherein louvers are arranged on a lower end surface of said gas-collecting hood for wind shutter.

8. A balanced high efficiency outdoor heater, as recited in claim 7, wherein a lower end of said second reflector connects to a meshed shield cover.

9. A balanced high efficiency outdoor heater, as recited in claim 8, wherein said pipe fittings are Tee pipe fittings.

10. A balanced high efficiency outdoor heater, as recited in claim 9, wherein an upper end of said burner is provided with a rain cover.

* * * * *